United States Patent [19]

Gueret

[11] Patent Number: 4,605,022

[45] Date of Patent: Aug. 12, 1986

[54] MAKE-UP POWDER COMPACT AND ITS APPLICATOR BRUSH

[75] Inventor: Jean-Louis H. Gueret, Paris, France

[73] Assignee: L'Oreal, Paris, France

[21] Appl. No.: 597,111

[22] Filed: Apr. 5, 1984

[30] Foreign Application Priority Data

Apr. 26, 1983 [FR] France ..... 83 06842

[51] Int. Cl.[4] ..... A45D 33/00

[52] U.S. Cl. ..... 132/82 R

[58] Field of Search ..... 132/82

[56] References Cited

U.S. PATENT DOCUMENTS 1,513,557 10/1924 Nash ..... 132/82 R 3,470,890 10/1969 Nakata ..... 132/82 R

*Primary Examiner*—Robert Peshock

*Attorney, Agent, or Firm*—Cushman, Darby & Cushman

[57] ABSTRACT

A make-up powder compact comprises a reservoir compartment and a take-up compartment which receives a brush applicator for the powder. A passage at the top of the compact intercommunicates these compartments and allows transfer of a dose of the powder into the take-up compartment when the compact is inverted. The brush has an outwardly flaring tuft of hairs to carry the powder and this tuft can be radially inwardly squeezed by means of an axially slidable collar, before the brush is returned to its duct in the take-up compartment.

14 Claims, 6 Drawing Figures

MAKE-UP POWDER COMPACT AND ITS APPLICATOR BRUSH

The present invention concerns a compact intended for the keeping and dispensing of a non-compacted make-up powder in a substantially fluid state, such as the compact described in French patent application No. 81.18.090 and the invention also concerns a powder applicator brush intended for such a compact.

The make-up powder compact described in the above mentioned patent application comprises an inner partition which divides it into two compartments, a first or reservoir compartment wherein there is initially introduced a supply of make-up powder and a second or take-up compartment wherein withdrawal of the powder doses is effected. The passage of the powder from the first reservoir compartment to the take-up compartment is effected simply by up-ending the compact because the above mentioned two compartments intercommunicate via a passage arranged between a free edge of the partition which is at the opposite end from the bottom of the compact and a facing side of the said compact. Thus the powder remaining in the reservoir compartment is not subjected to the compacting action exerted by the applicator at the time of the take-up and it can remain in a substantially fluid state. Moreover, the take-up compartment only contains a small portion of the powder initially introduced into the compact which contributes to limiting the risk of an unduly large take-up of the make-up powder. Moreover, the take-up compartment is traversed by an internal duct terminating just in the vicinity of the bottom of this compartment and is intended to accommodate a brush as powder applicator. In this way, the take-up of the make-up powder by the tuft of hair or bristles of the brush is effected in the take-up compartment within the compact and therefore without the risk of any dispersal of the powder outside the compact.

The inner, substantially conically shaped duct, joined at its larger cross section end to the top end of the compact and disposed substantially entirely within the latter, has a diameter which diminishes progressively towards the bottom of the compartment, the smaller cross section end of the duct being slightly spaced from the bottom of the take-up compartment. This duct thus allows the initial diameter of the tuft of hairs of the brush to be reduced so that the take-up of the powder is effected over the central portion of the free end of the duct and not over the whole surface of the latter. This makes it possible to prevent a take-up of an unduly large dose of make-up powder by the brush tuft and since, moreover, the diameter of the duct increases towards the outside of the compact, the brush tuft can, at the time it is extracted, progressively reassume its initial original diameter, thus preventing a sudden release of the hairs of the tuft and as a result, a splattering of the powder taken up.

In order to allow the initial introduction of a supply of powder into the compact, the reservoir compartment comprises at its bottom a filler hole which, after the introduction of the powder, is obturated, possibly irreversibly by a stopper; the latter may be made of a moulded plastic material and be fixed by ultrasonic welding to the make-up powder compact made of a moulded plastic material.

The applicator brush associated with the make-up powder compact comprises a tuft of hair or bristles having a substantially frustoconical shape, fixed to the smaller cross section end to a brush handle, and having at its larger cross section end a maximum diameter which is greater than the diameter of the end of the duct which is adjacent to the bottom of the take-up compartment, when the tuft of hair is not subjected to any constraint.

Finally, the powder compact and/or the brush have means allowing the brush to be detachably fixed within the duct and, in a particular variant of manufacture, these detachable fixing means consist of a detachable cover or cap on the upper end of the make-up powder compact and of a shape complementary to the free end of the brush stem which is intended to be pushed back towards the inside of the duct by the cap, the cap comprising closing elements such as a catch which engages elastically in a slot arranged on the upper side of the compact. It has been found in use that the hairs of the tuft separate from each other and that the tuft as a whole flares so that, even if initially the maximum diameter of the free end of the tuft is, in the absence of any constraints, smaller than the diameter of the larger cross section end of the duct so as to allow an easy insertion of the brush into the duct, the maximum diameter of the free end of the tuft very rapidly assumes a value greater than the diameter of the larger cross section end of the duct, so that it becomes impossible to insert the brush tuft in the duct without bending and deforming or breaking the peripheral hairs of the tuft on the edge of the duct which is accompanied by a splattering of powder, a rapid deterioration of the brush, and an adverse effect on the pleasing appearance of the unit.

The present invention aims to overcome this drawback whilst preserving the advantages presented by such a make-up powder compact and its applicator brush.

The present invention therefore provides a make-up powder compact to contain powder in a substantially fluid state, comprising a take-up compartment for a dose of powder, an internal duct in said take-up compartment and having a cross-section which decreases progressively towards the bottom of the said take-up compartment and has its smaller cross section end slightly spaced from the bottom of the take-up compartment; a powder applicator brush which comprises a handle and a tuft of hairs having, in the absence of any constraint, a substantially frustoconical shape with its maximum cross-section greater than the cross-section of the smaller cross section end of the duct, the tuft being fixed at its smaller cross section end to the end of the brush handle, said brush being detachably fixable in the duct so that when it is accommodated in the duct, the larger cross section free end of the tuft is substantially in contact with the bottom of the take-up compartment and the end of the brush handle remote from the tuft projects from the greater cross-section end of the duct, wherein the brush comprises a collar mounted around the said end of the brush handle and is movable between a first position in which the collar exerts substantially no constraint on the tuft and a second position in which the collar produces a transverse constriction of the tuft.

Thus, after having used the brush to powder herself, the user may, by displacing the collar from the first to the second position, retighten the hairs of the tuft so that the diameter of the free end of the tuft should be sufficiently diminished for the tuft to be inserted into the duct without difficulty.

In a preferred variant, which is very simple to make, the collar slides along the portion of the handle which is adjacent to the tuft between the two above mentioned positions, these positions being each defined by at least one stop on the collar engaging at least one stop of the brush handle.

The collar may be mounted with a calibrated tightening grip against at least one projecting element on the outer surface of the part of the handle over which the collar may be moved, so that, on the one hand, the friction between the collar and such projecting element or elements ensures that the collar is held in at least the second position after the user has displaced the collar from the first position into the second position and that, on the other hand, during the extraction of the brush, the collar can remain in the above mentioned first position which it occupies on the handle as the brush is inserted in the duct thanks to the cooperation of the duct with the collar as is described in greater detail below.

In a preferred embodiment, the end of the tuft which is fixed to the brush handle is engaged and held within a cylindrical sleeve which is itself engaged and held, at its end remote from the tuft, within one end of a tubular socket; the collar slides around the sleeve and has an inwardly projecting shoulder forming a stop which cooperates with an outwardly projecting stop shoulder on the end of the sleeve nearer the free end of the tuft when the collar occupies the second position; the end of the collar facing the socket constitutes another stop which, when the collar occupies the first position, cooperates with a stop constituted by the end of the socket wherein the sleeve is engaged. The brush is then constituted of four easily assembled elements: the tuft, sleeve, collar, and tubular socket.

When the brush is made in this way, it is advantageous for the projecting elements, against which the collar is mounted with a calibrated tightening grip, to be constituted by longitudinal ribs distributed over the lateral external surface of the sleeve.

When the brush is in place in the duct with the tuft which is free from radial constraint and in contact at its free end with the bottom of the take-up compartment, the collar may occupy in the said duct an extreme position in the direction of its penetration into the said duct and thus constitute a device for the detachable fixing of the brush in the duct by the wedging of the said collar in the ducts.

The collar advantageously constitutes, in the above mentioned extreme position, a stoppering device for the duct which makes it possible to prevent powder from passing into the duct during up-ending movements of the powder compact, in particular during the deliberate up-ending movements of the powder compact to ensure the transfer of small quantities of powder from the reservoir compartment to the take-up compartment.

Moreover, in the case where the collar constitutes a detachable fixing means for the brush in the duct, the tightening of the collar against the above mentioned outer projecting element(s) on the part of the brush handle over which the collar can be moved, is advantageously calibrated so that the force of friction between the collar and the said element or elements should be greater than the force of friction between the collar and the internal surface of the duct in the above mentioned extreme position of the collar. In this way, when the brush is being withdrawn from the duct, whilst the collar does not exert any constraint on the tuft, the collar frees itself from the inner surface of the duct without being displaced on the sleeve; in other words, when the user extracts the brush from the duct, the brush is automatically ready for use.

The collar may have an outwardly projecting peripheral bulge having a convex part, situated nearer the end of the collar which faces towards the tuft, with a transverse cross-section diminishing progressively towards the tuft from a maximum cross-section of the bulge. This bulge facilitates the manipulation of the collar by the user, but it also makes it possible, in cooperation with the duct receiving the brush, to limit the insertion of the brush in the duct after the collar has come into the first position on the brush handle, to serve as the means for removably holding the brush in the duct by the wedging of the collar against the inner surface of the duct, to position the brush suitably in the duct and to close it.

If, as indicated above, the collar is mounted with a calibrated tightening grip against at least one element projecting on the outer surface of the part of the handle over which the collar can be moved, and if this collar has the above mentioned projecting outwardly peripheral bulge, it is advantageous for the profile of the duct, the profile of the collar bulge and the tightening grip between the collar and the projecting element (or elements) on the handle to be calibrated so that when the brush is withdrawn from the duct, the collar frees itself from the inner surface of the duct without displacement on the handle.

The powder compact may furthermore have an internal partition dividing it into two compartments namely the take-up compartment and the reservoir compartment intended to contain a reserve of powder, the two compartments intercommunicating via a passage which is arranged between (a) a free edge of the partition remote from the bottom of the compact and (b) a facing side of the compact so that by upending the compact it is possible to transfer a small quantity of powder from the reservoir compartment to the take-up compartment.

The compact may also comprise a cap which is detachably fixed on the upper part of the compact around the greater cross section end of the duct, covering the free end of the brush handle, and pushing back the handle into the duct, and advantageously the internal side of the cap comprises brush-pushing elements which have a shape complementary to the free end of the handle and which bear against this free end when the cap is fixed on the compact so as to press the handle against the collar which is wedged in the duct, and occupying the first position on the handle.

In order to ensure rigidity for the cap without it being necessary to make it very thick, the thrusting elements are advantageously constituted by intersecting stiffener ribs of the cap which have cut-outs complementary in shape to the free end of the brush handle.

The cap may be detachably fixed on the compact, by an elastic fit around an upwardly projecting upper part of the compact where the duct opens out, by means of at least one catch of the cap elastically catch-engaging in a slot arranged in the said projecting part on the top of the compact. The said upwardly projecting part on top of the compact may have a substantially oval cross section of two rounded ends joined by straight sides, each of the rounded ends being provided with a substantially circular arcuate slot elastically receiving one of the two circular arcuate catches which project towards each other on the inner side of the base of the cap. This variant is very easy to make and inexpensive because the detachable fixing means of the cap on the compact can be made directly by moulding either on the compact or on the cap without it being necessary to attach any closing or articulating components whatsoever on the compact or on the cap.

In this latter case, the circular arcuate catches are preferably carried by two rounded portions of the cap, interconnected by two substantially parallel sides and at least partly reduced in thickness, these sides having a slight clearance with the facing sides of the upwardly projecting part of the compact so that pressing of the two sides towards each other in their zone of reduced thickness, by squeezing of the cap, facilitates the emergence of each catch out of its slot and hence the removal of the cap in order to gain access to the free end of the handle of the brush and to withdraw the brush from the duct.

To render the object of the present invention more readily understood, there will be described below, by way of a purely illustrative and non-restrictive example, an embodiment represented in the accompanying drawings. In these drawings.

Figure 1:
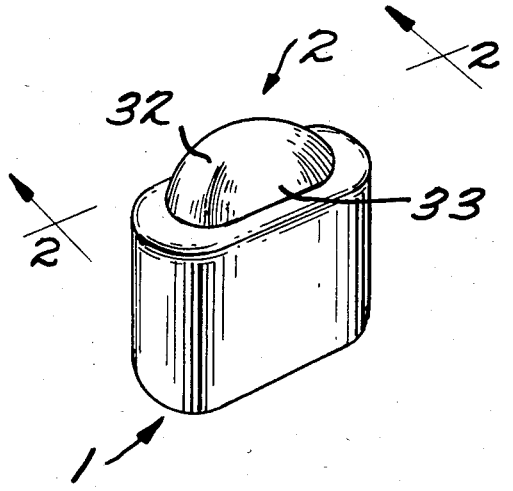
FIG. 1 is a perspective view of a make-up powder compact according to the invention with a cap fixed on it.
Figure 2:
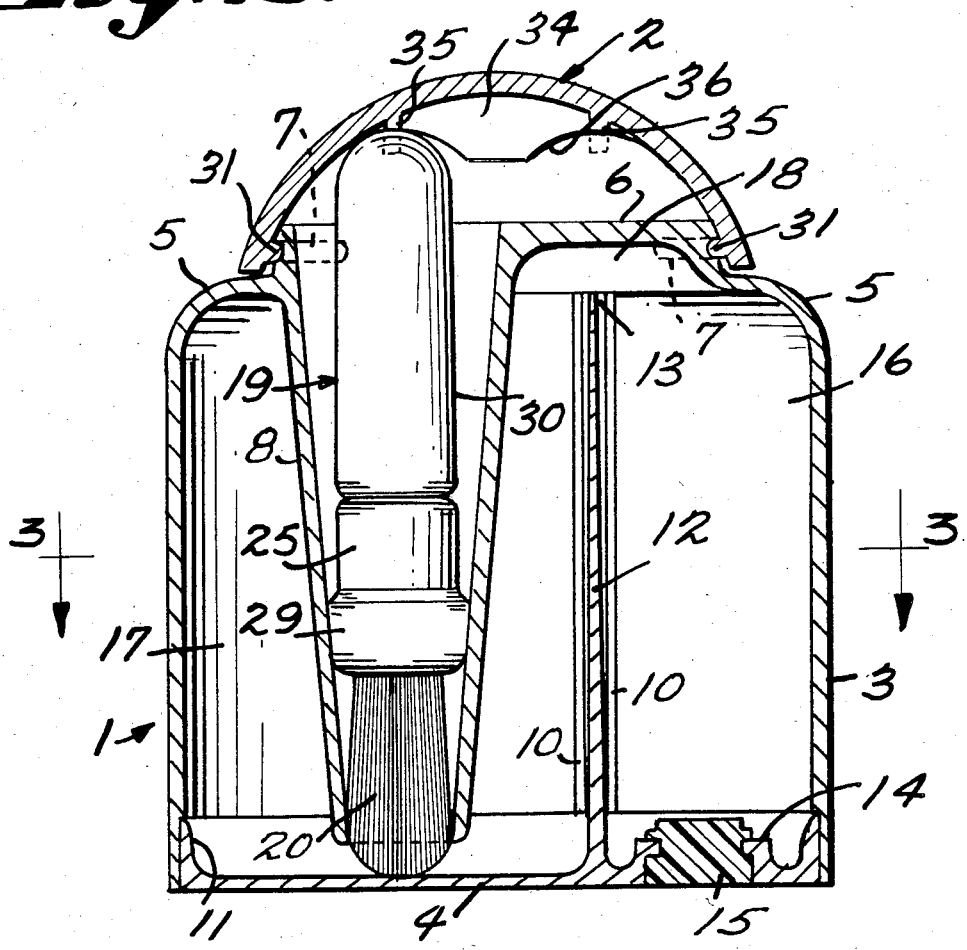
FIG. 2 is a section taken along the line II—II of FIG. 1.
Figure 3:
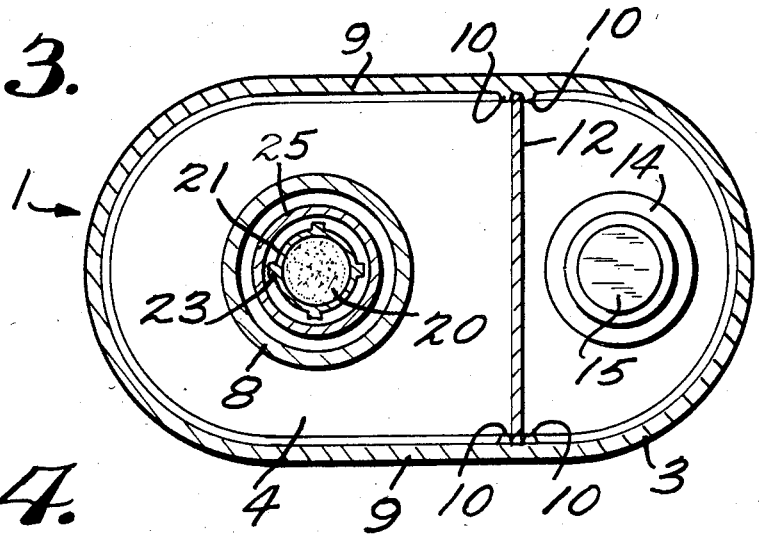
FIG. 3 is a cross section taken along line III—III of FIG. 2.
Figure 4:
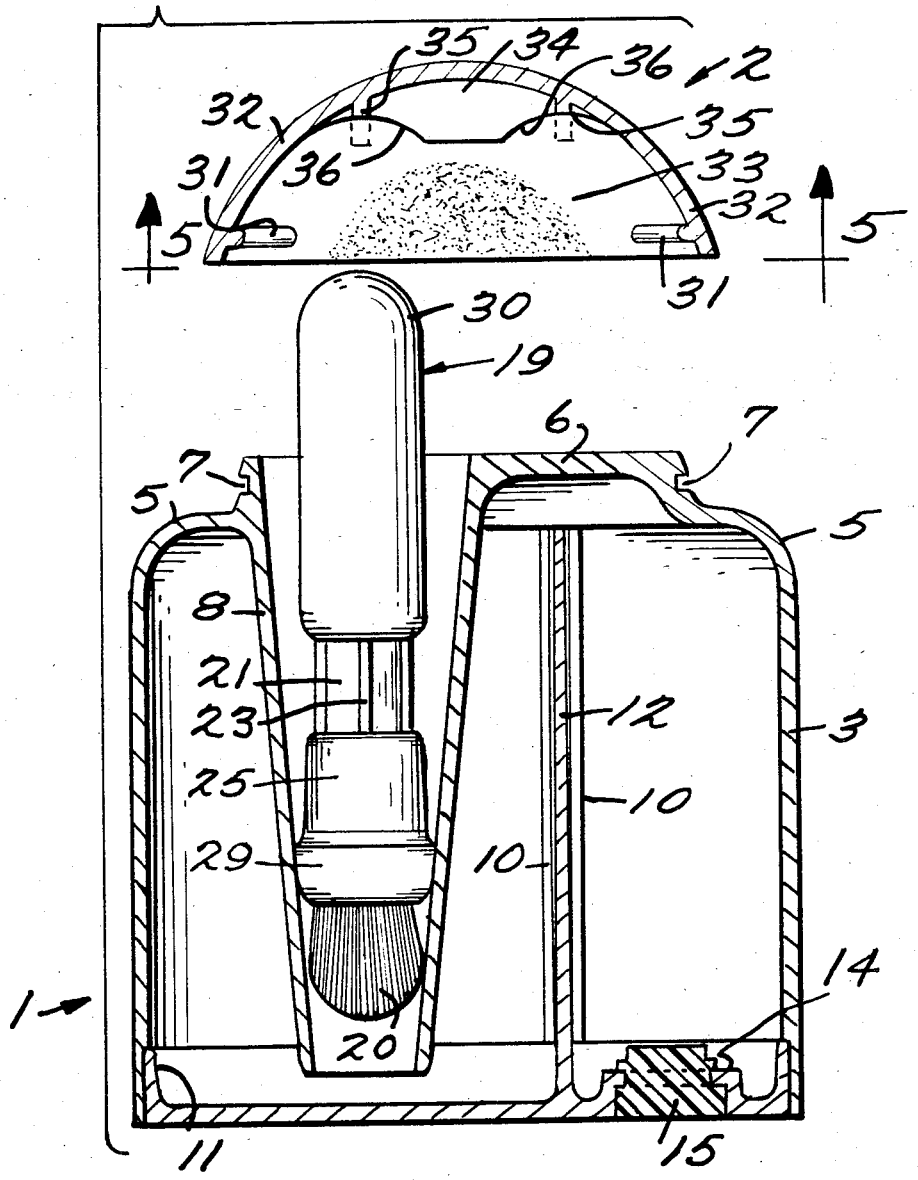
FIG. 4 is a vertical section, analogous to FIG. 2, showing the inserted brush in the duct before closure of the cap.
Figure 5:
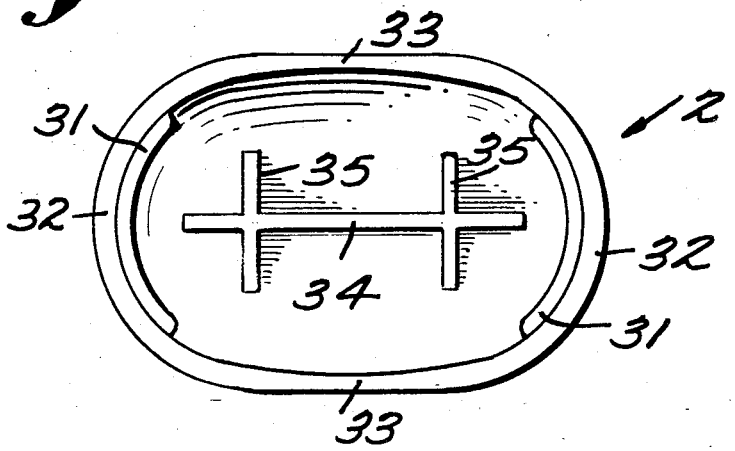
FIG. 5 is a view of the cap from below along line V—V FIG. 4.

Referring to FIG. 1 of the drawings, it will be seen that 1 designates a compact as a whole intended to enclose non-compacted make-up powder in a substantially fluid state, a cap 2 being capable of being detachably fixed on compact 1. Referring to FIGS. 2 to 4, compact 1 comprises a hollow body 3 and a bottom 4. Body 3 is formed by a cylindrical lateral wall whose cross section has the shape of two semicircles with the same radius facing each other and interconnected by a rectangle (see FIG. 3). The top end of this lateral wall is rounded off at 5 and is joined to an upper side which has a central portion 6 projection on top of compact 1. The central portion 6 has a cross section of the same shape as, but smaller than, that of the lateral wall of body 3 and a circular arc-shaped slot is arranged in the external lateral surface of each one of the two rounded semicircular portions of the projecting part 6. To this part 6, there is also joined the larger diameter upper end, of a frustoconical internal duct 8 whose smaller diameter lower end is spaced from the bottom 4 by a small distance. This duct 8 thus has a large cross section inlet opening which opens out in part 6 and a small cross section outlet opening which opens out opposite the bottom 4. The axis of symmetry of the duct 8 is eccentric in relation to the common axis of symmetry of the part 6 and of the lateral wall of the body 3, and each of the flat portions 9 of the lateral wall of body 3 has, internally on the side of the axis of symmetry common to the part 6 and to the body 3 away from the axis of symmetry of the duct 8, two vertical grooves which are opposite each other and are each defined by two slightly spaced apart parallel ribs 10 extending from the rounded top end 5 of the lateral wall as far as a recess arranged in the internal surface of that wall, on the periphery of the base of this lateral wall.

The body 3, whose structure has been described above, may be made from a single piece of a moulded plastic material.

Bottom 4, also made from a single piece of a moulded plastic material, has a peripheral flange 11 to enable the bottom 4 to be fitted in the recess of the base of the lateral wall of the body 3 and has a rectangular plate 12 whose thickness progressively diminishes from its lower end joining it to the bottom 4 towards its free upper end 13 so that when the bottom 4 is fitted within body 3, the plate 12 penetrates and slides via its two vertical sides in the two grooves defined between the ribs 10 of the body 3. Finally, the bottom 4 has, in its part situated to the side of plate 12 which faces away from the duct 8 of the body 3, a filler hole defined by an annular bead 14 carrying a radial shoulder towards the inside of its central passage. This filler hole may be closed by a stopper 15 which is possibly removable for re-use and is made of a relatively soft and flexible material, for instance, an elastomer. The stopper 15 has a peripheral groove so that it may be elastically catch-engaged within the bead 14 whose inner radial shoulder comes to be accommodated in the groove of the stopper 15. However, it is also possible for the stopper 15 to be fixed to the compact bottom 4, for instance by ultrasonic welding, after a supply of make-up powder has been introduced into the compact.

In effect, after the bottom 4 has been mounted and fixed to the body 3, the plate 12 constitutes an inner vertical partition inside the compact dividing the internal volume of the body 3 into two compartments, one 16 of which is above the bead 14 and stopper 15 and constitutes a reservoir compartment to receive a supply of powder, and the other 17 of which around the duct 8 constitutes a powder take-up compartment. These two compartments 16 and 17 communicate at their top portion via a passage 18 between the upper end 13 of the partition plate 12 and the inner facing side of the projecting part 6 of the upper end of the compact.

Figure 6:
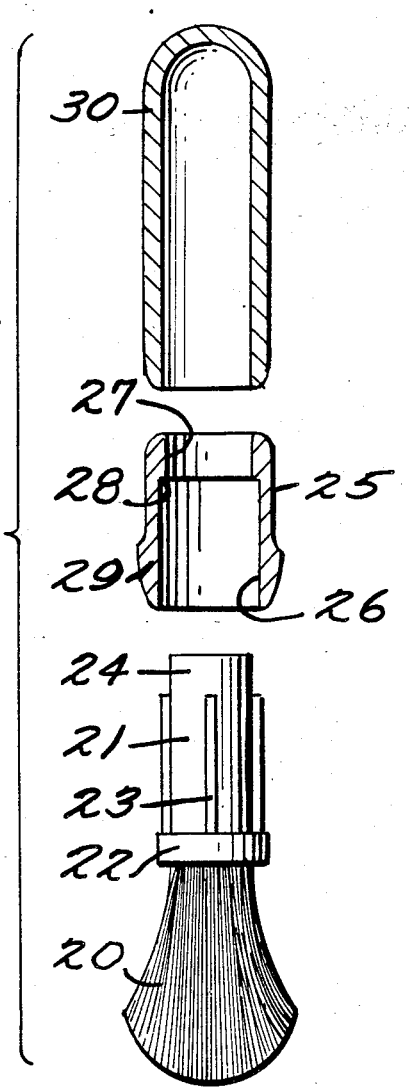
FIG. 6 is an exploded partly sectional view of the applicator brush of the powder compact of FIGS. 1 to 5.

The compact 1 is provided with an applicator brush 19 whose construction is shown in greater detail in FIG. 6. Brush 19 comprises a tuft of hair 20, substantially of a frustoconical shape, which is fixed at its small end to the lower end of a circular cross section cylindrical sleeve 21. The free end of the tuft 20 is shaped as a spherical cap and has a maximum diameter, in the absence of constraint, which is greater than the diameter of the smaller diameter lower end of the duct 8. Such a tuft of hair 20 is made up by engaging the upper end of a bunch of hairs, shaped as a circular cylinder, in the sleeve 21, through the lower end of the sleeve which is surrounded by a radially outwardly projecting annular shoulder 22. This combination is then disposed above a dish having the spherical cap shape which is to be imparted to the free end of the tuft 20 and, by means of a pusher which is introduced into the sleeve 21 at its top end, the hairs are pushed against the bottom of the dish. Finally, after withdrawing the pusher, glue is inserted in the sleeve 21 via the upper end of the latter and, after drying, the combination retains the configuration of the tuft 20 and the sleeve 21 shown in FIG. 6. Sleeve 21 has four longitudinal ribs 23, regularly interspaced on the external lateral surface and which stop short of the upper end of this sleeve 21 so that this upper end should be a smooth tubular portion 24.

The brush also comprises a collar 25 having a central bore 26 which opens out at the lower end of the collar and has a diameter which is greater than the diameter of the circle circumscribed by the ribs 23 (and slightly greater than the diameter of the shoulder 22, in order to slide on the shoulder) whilst a counter bore 27 opening out at the upper end of the bore 25 and coaxial with the bore 26 defines with the latter an inner radial shoulder 28 in the collar 25. Moreover, the diameter of the counter bore 27 ensures a calibrated tightening on the ribs 23 when the collar 25 is displaced along the ribs and is smaller than the diameter of the shoulder 22.

In this way, the collar 25 may be slidably mounted with calibrated friction on the sleeve 21 and be displaced towards the tuft 20 until the inner radial shoulder 28 of the collar 25 abuts the outer radial shoulder 22 of the lower end of the sleeve 21. In this position, it is clear that, as shown in FIG. 4, the collar 25 radially constricts the tuft 20. Around its lower end portion, the collar 25 has a convex outwardly projecting peripheral bulge 29, whose diameter progressively diminishes towards the lower end from a cross section with a maximum diameter, joined via a concave surface to the upper portion of the collar 25.

The brush 19 finally comprises a tubular socket 30 with a circular cross section, open at its lower end and closed at its upper end in the shape of a rounded dome. The internal diameter of the socket 30 is slightly greater than the external diameter of the smooth end 24 of the sleeve 21, whereas the external diameter of the socket 30 approximates to the external diameter of the upper portion of collar 25. The end 24 of the sleeve 21 may thus be engaged and glued in the socket 30 so that the upper ends of the ribs 23 should be adjacent to the lower end of the socket 30 after the collar 25 has been caused to slide on sleeve 21 into the position of radially constricting the tuft 20, that is to say until the shoulder 28 bears against the shoulder 22. Since the axial length of the collar 25 is slightly smaller than that of the sleeve 21, the collar 25 is thus movable on this sleeve 21 between two positions of which one, already defined above, is a position for the radial constriction of the tuft 20 and the other, where the upper end of the collar 25 bears against the lower end of the socket 30 and where the shoulder 22 remains engaged in the bore 26, is a position in which the collar 25 exerts practically no constraint on the tuft 20 and allows the tuft to assume a flared shape. The calibrated friction between collar 25 and the sleeve 21, by cooperation of the counter bore 27 with the ribs 23, allows the collar 25 to be held in each of its two positions into which the collr can be brought by the user. The handling of the collar is facilitated thanks to its convex external bulge 29. Like the body 3 and the bottom 4, the sleeve 21, collar 25 and socket 30 of the brush can be made of a moulded plastic material.

The cap 2 shown in FIGS. 1, 2, 4, and 5 is dome-shaped and has a base whose cross-section corresponds to that of the projecting portion 6 which this base surrounds when the cap 2 is fixed on the compact by elastic catch engagement, in the two slots 7 of this portion 6, of two complementary circular arcuate catches 31 projecting towards each other and each on the internal surface of one of the two rounded end portions 32 of the cap 2 which are interconnected by two substantially flat parallel sides 33 of reduced thickness in relation to the other portions of cap 2.

Each of these sides 33 of the cap may have a slight clearance from the facing side of the projecting portion 6, when the cap 2 is elastically fitted on this portion 6. The cap 2 is stiffened by a central longitudinal rib 34 which is intersected at right angles by two transverse ribs 35, and cut-outs such as 36 of these ribs define two bearing spherical caps of a shape substantially complementary to that of the upper rounded end of the socket 30 of the brush 19. Such a cap 2 may also be made of a moulded plastic material.

When the brush 19 is fixed in the duct, as has been shown in FIG. 2, the cap 2 which is itself fixed on the compact bears by one of the spherical caps, defined by the cut outs 36 of the ribs 34 and 35, on the upper end of socket 30 so that the socket lower end bears against the upper end of collar 25. The collar 25 is squeezed at its bulge 29 within the duct 8 and the free end of the tuft 20 which passes through the smaller diameter lower end of the duct 8, substantially abuts with the bottom of the take-up compartment 17.

Filling of the make-up powder compact may be effected in the factory by the manufacturer, preferably in a partial vacuum, and the brush is immediately put in place in order to prevent any powder leakage. The powder is introduced via the filler hole defined by the bead 14 in the compact bottom 4, and this hole is then closed by means of stopper 15.

The compact is intended to be marketed in association with the applicator brush 19.

The make-up powder is initially contained in the reservoir compartment 16. When the compact is inverted a small quantity of the powder passes from the reservoir compartment 16 into the take-up compartment 17 and eventually accumulates at the bottom of this compartment when the compact is righted before use. The user can take up several doses of powder by means of the brush 19 before again up-ending the compact to obtain a new transfer of a small quantity of powder from the reservoir compartment 16 to the take-up compartment 17. Within the conical duct 8, the end of the tuft 20 is subjected to a reduction of its initial diameter so that the take-up of the powder is effected solely at the centre of the tuft end, which has the advantage of preventing the take-up of an unduly large quantity of powder by the brush. When the brush is withdrawn from duct 8, since the diameter of the latter progressively increases towards the outside of the compact, the tuft 20 may progressively reassume its initial diameter which avoids any sudden release of the hairs and prevents the taken up make-up powder from splattering.

Starting from the upright position shown in FIG. 2 where the brush 19 is fixed in the compact, when the user wishes to extract the brush, she squeezes the cap 2 by pressing together the two reduced thickness sides 33 of the cap 2 which produces a slight separation of the catches 31 which are therefore freed to a certain extent from the slots 7. This makes it possible to reduce the force to be exerted on the cap 2 for prizing it off the compact. Then the user seizes the rounded upper end of the brush socket 30 which projects above the inlet opening at the upper end of the duct 8 and, by pulling on the socket 30, withdraws the brush 19 from the compact. The tightening action of the collar 25 on the ribs 23 of sleeve 21 is calibrated so that the force of friction between the collar 25 and the ribs 23 is greater than the force of friction between the bulge 29 of the collar 25 and the wall of the duct 8. The collar 25 therefore retains the FIG. 2 position during the extraction of brush 19 from the compact, and the user may immediately use the brush for powdering herself. When she wishes to reinsert brush 19 in the compact, she displaces the collar 25 into the radial constriction position of the tuft 20, shown in FIG. 4, then inserts the brush 19 into the duct 8 until the bulge 29 of the collar 25 contacts the wall of the duct 8. Then the user places cap 2 on the rounded end of the socket 30 and subsequently pushes the cap 2 towards the compact in order to engage the catches 31 elastically in the slots 7. Doing this, one of the bearing spherical caps defined by the ribs 34 and 35 presses downwardly on the brush socket 30 which cause the sleeve 21 to slide within the collar 25 squeezed in the duct 8, until the brush 19 reassumes the position, shown in FIG. 2, wherein the tuft 20 has its free end substantially in contact with the bottom of the take-up compartment 17.

The unit constituted by the brush 19 and the compact is thus ready for a new take-up action.

It shall be duly understood that the embodiment described above is in no way restrictive, and may give rise to any desirable modifications without thereby departing from the scope of the present invention as defined by the following claims.

I claim:

1. A make-up powder compact to contain powder in a substantially fluid state, comprising: a take-up compartment for a dose of powder, an internal duct in said take-up compartment and having a cross-section which decreases progressively towards the bottom of the said take-up compartment and has its smaller cross-section end slightly spaced from the bottom of the take-up compartment; a powder applicator brush which comprises a handle and a tuft of hairs having, in the absence of any constraint, a substantially frustoconical shape with its maximum cross-section greater than the cross-section of the smaller cross-section end of the duct, the tuft being fixed at its smaller cross section end to the end of the brush handle, said brush being detachably fixable in the duct so that when it is accommodated in the duct, the larger cross section free end of the tuft is substantially in contact with the bottom of the take-up compartment and the end of the brush handle remote from the tuft projects from the greater cross-section end of the duct, wherein the brush comprises a collar mounted around the said end of the brush handle and is movable between a first position in which the collar exerts substantially no constraint on the tuft and a second position in which the collar produces a transverse constriction of the tuft.

2. A powder compact according to claim 1, including first stop means on the collar and the brush handle to define said first position of the collar, and second stop means on the collar and the brush handle to define said second position each defined by the co-operation of the collar.

3. A powder compact according to claim 1, including external means on said brush handle at said end thereof for exerting calibrated friction on said collar.

4. A powder compact according to claim 1, wherein said collar has first and second ends; wherein said handle comprises tubular socket means and a cylindrical sleeve each having first and second ends; wherein said smaller cross-section end of the tuft is engaged and held within a said first end of said cylindrical sleeve and said second end of said cylindrical sleeve is itself engaged in and held at said first end of said tubular socket means; wherein said first stop means comprise said first end of said tubular socket means and said first end of said collar slidably mounted on said sleeve; and wherein said collar has an inwardly projecting shoulder and said sleeve includes at its first end an outwardly projecting shoulder which together with said inwardly projecting shoulder forms said second stop means.

5. A powder compact according to claim 4, including longitudinal ribs distributed over the external lateral surface of said handle and engaging said collar with a calibrated friction.

6. A powder compact according to claim 1, wherein when the brush is in position in the duct with the tuft free of constraint and in contact by its free end with the bottom of the take-up compartment, the collar occupies in the said duct an extreme position in the direction towards said smaller cross-section end of the duct and thus constitutes a releasable fixing element for the brush in the duct by wedging of the collar in the duct.

7. A powder compact according to claim 6, wherein the collar constitutes, in said extreme position, a stoppering element for the duct.

8. A powder compact according to claim 6, including external means on said brush handle at said end thereof for exerting a calibrated friction on said collar, and wherein said friction between the collar and said external means on the handle is calibrated to be greater than the force of friction between said collar and the inner wall of said duct in said extreme position of the collar in the duct.

9. A powder compact according to claim 1, including an external peripheral bulge on said collar, said peripheral bulge having a convex part nearer the end of the collar which is adjacent the tuft which part has a cross section which progressively decreases from a maximum cross section of the bulge in a direction towards the tuft.

10. A powder compact according to claim 1, and further including: an inner partition to separate said compact into two compartments, namely said take-up compartment and reservoir compartment to contain a reserve of powder, said partition having an upper free edge remote from said bottom of the take-up compartment; and passage means intercommunicating said two compartments and arranged between said upper free edge of the partition and a facing upper wall of the compact, said passage means allowing a dose of powder to be transferred from said reservoir compartment to said take-up compartment when the compact is upended.

11. A powder compact according to claim 1, wherein said brush handle has a free end remote from said tuft; and further including: a cap to the compact; means removably fixing the cap on the upper part of the compact, around the larger cross section end of the duct, covering said free end of the handle; brush thrusting means on the inner surface of the cap with a shape complementary to that of the free end of the handle and bearing against said free end as the cap is fixed on the compact so as to press said handle into said duct.

12. A powder compact according to claim 11, wherein said cap thrusting means comprise intersecting stiffening ribs of the cap which ribs have cut-outs complementary to the shape of said free end of the handle.

13. A powder compact according to claim 11, wherein said upper part of the compact is of oval shape with rounded ends joined by straight sides, and wherein the means removably fixing the cap on the compact comprise internal arcuate circular catches of the cap and means defining a respective external substantially circular arcuate slot in each of the rounded ends of said top of the compact for elastically catch-engaging one of said two internal arcuate circular catches of the cap which surrounds the said top of the compact.

14. A powder compact according to claim 13, wherein the cap has an oval shape comprising rounded ends joined by straight sides, wherein said circular arcuate catches are carried by the two rounded ends of the cap, interconnected by two substantially parallel sides and wherein said straight sides are at least partly of a reduced thickness and each define a slight clearance with the adjacent straight side of the top of the cap when the cap is fixed on the compact so that pressing the two straight sides of the cap towards each other in their zone of reduced thickness facilitates the emergence of the catches out of the slots.

* * * * *